United States Patent [19]

Sung et al.

[11] 3,969,235

[45] July 13, 1976

[54] SULFURIZED CALCIUM ALKYLPHENOLATE COMPOSITIONS

[75] Inventors: Rodney L. Sung, Fishkill; Harry Chafetz, Poughkeepsie; Benjamin H. Zoleski, Beacon; Walter D. Foucher, Jr., Fishkill, all of N.Y.

[73] Assignee: Texaco Inc., New York, N.Y.

[22] Filed: Aug. 26, 1974

[21] Appl. No.: 500,965

[52] U.S. Cl. ..... 252/42.7; 252/47.5
[51] Int. Cl.[2] ..... C10M 1/38
[58] Field of Search ..... 252/42.7, 46.7, 47.5

[56] References Cited

UNITED STATES PATENTS

| | | | |
|---|---|---|---|
| 2,905,639 | 9/1959 | Krzikalla et al. | 252/47.5 X |
| 3,219,666 | 11/1965 | Norman et al. | 252/51.5 A X |
| 3,228,888 | 1/1966 | Spivack et al. | 252/47.5 X |
| 3,474,035 | 10/1969 | Dadura | 252/42.7 |
| 3,528,917 | 9/1970 | Dadura et al. | 252/42.7 |
| 3,549,534 | 12/1970 | Holstedt et al. | 252/42.7 |
| 3,706,632 | 12/1972 | Day et al. | 252/42.7 |
| 3,761,414 | 9/1973 | Haugen et al. | 252/42.7 |
| 3,801,507 | 4/1974 | Hendrickson et al. | 252/42.7 |
| 3,810,837 | 5/1974 | Chafetz et al. | 252/42.7 |

*Primary Examiner*—Delbert E. Gantz
*Assistant Examiner*—Andrew H. Metz
*Attorney, Agent, or Firm*—T. H. Whaley; C. G. Ries; Robert A. Kulason

[57] ABSTRACT

A lubricating oil composition containing sulfurized calcium alkylphenolate detergent dispersant of superior resistance to oxidation prepared by (1) reacting at a temperature between 200° and 425°F. alkylphenol with a first addition of calcium alkoxyalkoxide to form a calcium alkylphenolate containing first reaction mixture utilizing between about 45 and 90 wt. % of the stoichiometric amount required to convert the alkylphenol to calcium alkylphenolate, (2) contacting the calcium alkylphenolate first reaction mixture with sulfur at a temperature between about 440° and 460°F. in the presence of between about 13 and 20 wt. % of a hydrocarbon lubricating oil based on step 2 second reaction mixture, and (3) contacting the second reaction mixture with a second addition of calcium alkoxyalkoxide at a temperature between about 350° and 425°F., said first and second addition totalling between about 100 and 120% of the stoichiometric amount of calcium alkoxyalkoxide to form said calcium alkylphenolate, said steps 1 and 3 being advantageously conducted while blowing their respective reaction mixtures with inert gas, step 2 being conducted while sequentially blowing step 2 reaction mixture with inert gas, carbon dioxide and inert gas.

11 Claims, No Drawings

SULFURIZED CALCIUM ALKYLPHENOLATE COMPOSITIONS

BACKGROUND OF INVENTION

This invention is in the field of art relating to fluid compositions specialized and designed for use between two relatively moving surfaces in contact therewith for reducing friction therebetween and preserving the surface. Lubricant compositions of the invention contain a compound which has a calcium component linked to carbon through oxygen.

It is well known that lubricating oils tend to deteriorate under conditions of use in present day diesel and automotive engines with attendant formations of sludge, lacquer and resinous materials which adhere to the engine parts, particularly the piston ring, groove and skirt, thereby lowering the operating efficiency of the engine. To counteract the formation of these deposits, certain chemical additives have been found which when added to lubricating oils have the ability to keep the deposit forming materials suspended in oil so that the engine is kept clean and in efficient operating condition for extended periods of time. These agents are known in the art as detergent-dispersants. Metal organic compounds are particularly useful in this respect. One class of metal organic compounds which have been found so useful are the sulfurized normal and overbased calcium alkylphenolates. It is to be noted that the term "normal" employed hereinbefore and hereinafter denotes the ratio of the number of equivalents of calcium moiety to the number of equivalents of alkylphenol moiety is 1, that is, the calcium metal ratio is 1. The term "overbased" denotes ratio greater than 1.

Although the sulfurized calcium alkylphenolates of the past were effective detergent-dispersants, they were found to be somewhat less than satisfactory in that they were prone to oxidative deterioration resulting in the formation of corrosive products which attack the metal surface of the engines under severe operating conditions. Further under severe operating conditions, such as in diesel engine operations, the sulfurized calcium alkylphenolates form oxidation products which undesirably result in a substantial change in lubricant viscosity. In an effort to solve this problem, improved sulfurized calcium alkylphenolates containing lubricant compositions more resistant to oxidation were formulated as covered in U.S. Pat. Nos. 3,528,917, 3,549,534 and 3,761,414. However, with the ever increasing demands, the anti-pollution controls placed on today's engine oils, there is a continuing search for additives such as the sulfurized normal calcium alkylphenolates of even still further improved resistance to undesirable oxidation in engine operating conditions.

SUMMARY OF INVENTION

We have discovered and this constitutes our invention an improved sulfurized calcium alkylphenolate lubricant composition which is substantially less susceptible to undesired oxidation during engine operating and substantially less corrosive to the metal engine parts such as silver, copper, iron, steel and iron and lead metal surfaces. More specifically, we have unexpectedly discovered when the product defining process of U.S. Pat. No. 3,761,414 is modified by conducting the sulfurization step at a temperature between about 440° and 460°F. in a hydrocarbon lubricating oil present in an amount between about 13 and 20 wt. % of the sulfurization reaction phase there results a sulfurized calcium alkylphenolate of even further improved resistance to oxidative deterioration as measured by the change in the lubricating oil viscosity and engine corrosion.

DETAILED DESCRIPTION OF THE INVENTION

Specifically, the lubricating composition of the invention is prepared by essentially a 3-stage procedure:

In the first stage in the presence of a lubricating oil, there is contacted (1) an alkylphenol of the formula:

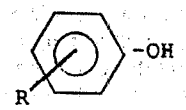

where R represents 1 or 2 monovalent saturated aliphatic radicals of from 5 to 50 carbons, preferably 10 to 15 carbons and where at least one ortho or para position remains unsubstituted with a first addition of a calcium alkoxyalkoxide of the formula:

$$Ca(O-A-OR')_2$$

where A is a divalent saturated aliphatic hydrocarbon radical (alkanediyl) of 1 to 6 carbons and R' is alkyl of from 1 to 25 carbons at a temperature between about 200° and 425°F., preferably between about 320° and 425°F., utilizing a mole ratio of calcium alkoxyalkoxide to alkylphenol of between about 0.225:1 and 0.45:1, that is, an amount of calcium alkoxyalkoxide of between about 45 and 90 wt. % of stoichiometric to form a first reaction mixture. Reaction period is conducted until essentially all the alkoxyalkoxide has been reacted which is generally between about 0.5 and 8 hours.

As a second stage, contacting the resultant first stage mixture after removing volatile solvent (if employed) with sulfur at a temperature between about 440° and 460°F., preferably about 450°F., in the presence of between about 13 and 20 wt. % of a hydrocarbon lubricating oil of an SUS viscosity of between about 50° and 2500° at 100°F. utilizing a mole ratio of sulfur to initial alkylphenol of between about 0.5:1 and 8:1, preferably between about 0.5:1 and 3, to form a second reaction mixture while advantageously passing through the second reaction mixture, sequentially, inert gas, carbon dioxide and inert gas until no detectible $H_2S$ odor is found which is normally measured at less than 3 ppm $H_2S$ and a copper strip corrosion (ASTM D-130) of a 2A maximum (3 hours — 212°F.). An inert and $CO_2$ gas rate of between about 0.1 to 10 SCFH/gallon is advantageously employed. The carbon dioxide functions as a deodorizing agent whereas the inert gas functions to facilitate removal of volatile components in the reaction mixture. The reaction time in the second stage is generally between about 0.5 and 10 hours.

Then, as a third stage, contacting the gas blown second reaction mixture with a second amount of calcium alkoxyalkoxide at a temperature between about 350° and 425°F., preferably between about 400° and 425°F., utilizing between about 0.15 and 0.375 moles of calcium alkoxyalkoxide per mole of original alkylphenol, the first and second additions of calcium alkoxyalkoxide totalling between about 100 and 120% of stoichiometric. The third stage reaction time is generally between about 0.5 and 8 hours. In the third stage additional hydrocarbon lubricating oil diluent is preferably added advantageously bringing the total hydrocarbon oil diluent content in the third stage to about 40 and 70 wt. % of the third stage reaction mixture. When the combined amount of calcium alkoxyalkoxide employed in the first and third stage is greater than stoichiometric an overbased product is produced, i.e., where the calcium ratio is greater than 1.

The diluent oils employed in the preparation of the sulfurized calcium alkylphenolate also function to form a portion of the base oil in the final compositions containing the sulfurized normal alkylphenolate. Suitable base oils and diluent oils include a variety of hydrocarbon lubricating oils such as naphthenic base, paraffinic base and mixed naphthenic and paraffinic base oils having an SUS viscosity at 100°F. of between about 50 and 250, preferably between about 90 and 150. In formulating diesel lubricating oil compositions, the finished compositions desirably have an SUS viscosity between about 900 and 1100 at 100°F.

Under advantageous conditions in the first and third stages, the calcium alkoxyalkoxide reactant is introduced into the reaction system as a solution, if not already in the liquid form, to facilitate reaction contact. The solvent medium is usually the corresponding alkoxyalkanol (if liquid) of the alkoxyalkoxide component. The concentration of the calcium alkoxyalkoxide in the solvent medium is normally between about 20 and 60 wt. %. The solvent is advantageously removed as overhead during the early phase of each stage. In the second stage sulfurization, the sulfur is desirably introduced as a slurry with the hydrocarbon diluent.

In the second sulfurization state, the sulfur is desirably introduced as a slurry in a hydrocarbon lubricating oil, such slurry most preferably having a sulfur content of about 40 to 70 wt. %. The lubricating oil, as in all stages, continues on and makes up a portion of the final concentrate product.

In addition in the second stage, the first and third stage reactions are advantageously conducted in an inert gas atmosphere, e.g., employing inert gas blowing (0.1–10 SCFH/gallon). Further, agitation is normally employed in all three stages of the procedure in order to facilitate ingredient contact.

The final product is filtered, if such is required, by standard means. The preferred filtration is accomplished by adding to the final mixture between about 0.01 and 1 wt. % diatomaceous earth and passing the material to be filtered through a press leaf filter precoated with diatomaceous earth at a temperature between about 200° and 300°F. and a pressure between about 5 and 1000 psig.

As heretofore stated, the two critical modifications of the prior art procedure as represented by U.S. Pat. No. 3,761,414, namely, conducting the sulfurization stage at a temperature between about 440° and 460°F. in the presence of between about 13 and 20 wt. % hydrocarbon lubricating oil diluent as defined unexpectedly results in a sulfurized calcium alkylphenolate of a resistance to oxidative deterioration far superior in respect to known sulfurized calcium alkylphenolates. Although an explanation of this unexpected occurrence is not known with reasonable certainty, the following theorized explanation is given:

Firstly, sulfurized calcium alkylphenolate is in actuality a complex mixture of many compounds including mono and polysulfides. The polysulfides are less stable than the monosulfides. Apparently, in the sulfurization step a maximum quantity of monosulfide component is produced at the temperature of 440° to 460°F. with temperatures below 440°F. favoring the production of less stable components such as the polysulfides, and above about 460°F. favoring formation of unstable cleavage products.

Secondly, in respect to the criticality of between about 13 and 20 wt. % hydrocarbon lubricating oil diluent in the second stage, if more than about 20 wt. % oil is employed in the sulfurization stage, too many sites are provided by the oil in competition with the calcium alkylphenolate for the sulfur, having the result of reduced amounts of sulfur attached to the alkylphenol moieties, thus rendering a product more susceptible to oxidative deterioration. Further, it is theorized less than about 13 wt. % diluent oil in the sulfurization stage also results in a product of resultant lower sulfur alkylphenol bonding, since it appears the reaction is significantly retarded when less than about 13 wt. % oil is employed.

The formed sulfurized calcium alkylphenolate product contents in lubricating oil compositions contemplated herein range anywhere from 0.1 to 90 wt. %. The higher concentrations, e.g., between about 10 and 90 wt. % sometimes referred to in the art as concentrates are normally found in lubricant compositions resulting directly from the manufacture of the sulfurized calcium alkylphenolate ingredient in finished (dilute) lubricating oil compositions employed for engine use is desirably between about 0.1 and 7.5 wt. % with a calcium concentration of between about 0.06 and 0.5 wt. %, preferably about 0.1 and 0.4 wt. %. The concentrates are principally formed for storage and transport and are subsequently blended to finished oil compositions for engine use having a sulfurized calcium alkylphenolate of between about 0.1 and 10 wt. %.

In the finished lubricating oil compositions, other additives may be included such as supplementary dispersants, pour depressors, antioxidants, silver corrosion inhibitors, viscosity index improvers, oleogenous agents and antifoamant mixtures thereof. Exactly what other additives are included in the finished oil and the particular amounts therein will, of course, depend on the particular use the finished product is to be put to. One of the most suitable uses found for the sulfurized calcium alkylphenolate produced herein are lubricants for railway diesel engines. Examples of additives found in railway diesel engine oils in addition to the sulfurized calcium alkylphenolate are as follows:

One preferred supplementary detergent-dispersant, ethoxylated inorganic phosphorus acid free, steam hydrolyzed, polybutene-$P_2S_5$ reaction products further described in U.S. Pat. Nos. 3,272,744 and 3,087,956. This supplementary detergent appears to cooperate with the subject sulfurized calcium alkylphenolate to enhance detergency and thermal stability and resistance to undesired oxidative decomposition. The ethoxylated product is present in the finished compositions of the invention in amounts between about 0.3 and 10 wt. % (oil free basis), preferably between about 0.8 and 4 wt. %, and in any case in sufficient amount to give a phosphorus content in the finished (dilute) compositions of between about 0.03 and 0.15 wt. %, preferably between about 0.01 and 0.08 wt. %.

Another supplementary detergent dispersant employed as an alternative to the aforedescribed ethoxylated inorganic phosphorus acid free, steam hydrolyzed polybutene-$P_2S_5$ reaction product are the $C_{50}$-$C_{200}$ alkenyl succinimide derivatives of alkylene polyamines of the type described in U.S. Pat. Nos. 3,172,892 and 3,210,383. This alternative supplementary detergent, like the aforementioned polybutene-$P_2S_5$ derivative, appears to complement the subject sulfurized calcium alkylphenolate to enhance the detergency, thermal stability and resistance to undesired oxidative decomposition. The succinic anhydride derivative is present in the finished compositions of the invention on a neat basis of between about 1.0 and 10 wt. % and in sufficient amount to give a nitrogen content in the finished (dilute) composition of between about 0.01 and 0.12 wt. %, preferably between about 0.015 and 0.3 wt. %.

Still another additive which may be included in the compositions of the invention in addition to the supplementary detergents are the 2,5-bis-$C_5$-$C_{20}$ alkyldithiothiadiazole such as 2,5-bisoctyldithiothiadiazole which function as antioxidants, sulfur scavengers and antiwear agents. The dithiothiadiazoles are advantageously employed in an amount of between about 0.01 and 1 wt. %, preferably between about 0.02 and 0.1 wt. % of the finished oil composition.

A still further specific additive which is advantageously included along with the supplementary detergent and antioxidant is the polymeric dimethyl silicone antifoamants. The silicone polymers are desirably employed in amounts of about 100 to 1000 ppm.

Specific examples of the alkylphenol reactants contemplated herein are 4-octylphenol, 4-t-octylphenol, 2-decylphenol, 2-dodecylphenol, 4-hexadecylphenol, 3,4-didodecylphenol, 2-nonylphenol, 4-tricontylphenol, 4-eicosylphenol and a mixture of decyl and dodecyl phenol ($C_{10}$+$C_{12}$ alkylphenol) and a mixture of 2 and 4 positioned monoalkyl and dialkylphenols. It is to be noted that the alkylphenols employed will normally be p-alkylphenols, however, 2,4-substituted alkylphenols may also be employed. The only restriction is an ortho or para position of the alkylphenol reactant is desirably available for sulfurization.

Examples of the calcium alkoxyalkoxide reactants contemplated herein are calcium 2-methoxyethoxide, calcium 2-methoxypropoxide, calcium 3-methoxybutoxide, calcium 2-ethoxyethoxide and calcium 4-dodecoxyhexoxide. Their corresponding alkoxyethanol diluents are 2-methoxyethanol, 2-methoxypropanol, 3-methoxybutanol, 2-ethoxyethanol and 4-dodecoxyhexanol.

The inert gas normally employed is nitrogen and, most preferably, nitrogen with a purity of at least about 99 wt. %.

As heretofore stated the sulfurized calcium alkylphenolates are in actuality a complex mixture of many compounds. One hypothetical representation employed in the art is as follows:

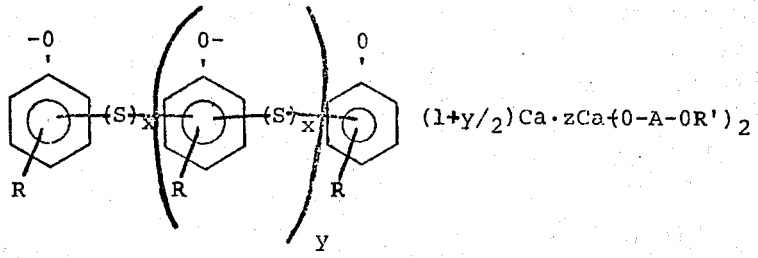

where R, R′ and A are as heretofore defined, $x$ is an integer from about 1 to 4, $y$ is an average integer of from 0 to 10 and $z$ is an average integer of 0 to about 0.1. When $z$ is greater than 0 the sulfurized product is considered overbased.

The foregoing formula is only set forth as a visual representation since sulfurized calcium alkylphenolate is in essence a complex mixture of many substances including mono- and polysulfides, and therefore, the product can only be truly defined only in terms of process. In any case, the R group is believed to be primarily in the para position and the sulfur linked mainly in the ortho position. Further, there is probably also a significant amount of covalent character for the calcium-oxygen bond. It is to be noted that the calcium and sulfur contents of the sulfurized calcium alkylphenolate component are respectively between about 1 and 8 wt. % and 0.5 and 12 wt. %.

In regard to the aforementioned supplementary ethoxylated derivative of inorganic phosphorus acid free, steam hydrolyzed polybutene-$P_2S_5$ reaction product, it is prepared by first reacting a polybutadiene of a molecular weight of between about 800 and 2500 wherein the reaction constitutes between about 5 and 40 wt. % $P_2S_5$ at an elevated temperature of between about 212° and 600°F. in a non-oxidizing atmosphere, e.g., nitrogen followed by hydrolyzing the resultant product by contacting with steam at a temperature between about 212° and 500°F. The steam treatment of the $P_2S_5$-polybutene reaction product results in its hydrolysis to form inorganic phosphorus acids in addition to the hydrolyzed organic product. Hereinbefore and hereinafter the term "polybutene" denotes derivatives of isobutene as well as butene. The inorganic phosphorus acids are removed from the hydrolyzed product prior to reaction with alkylene oxide via standard procedures such as those disclosed in U.S. Pat. No. 2,987,512 and U.S. Pat. No. 2,951,835 wherein removal is effected by contact with synthetic hydrous alkaline earth metal silicates and synthetic hydrous alkali metal silicates, respectively. Inorganic phosphorus acids can also be removed by extraction with anhydrous methanol as disclosed in U.S. Pat. No. 3,135,729. Steam hydrolyzed inorganic phosphorus acid product is then contacted with ethylene oxide at a temperature between about 140° and 300°F. under pressure ranging from 0 to 50 psig utilizing a mole ratio of ethylene oxide to hydrolyzed hydrocarbon-$P_2S_5$ reaction product of between about 1:1 and 4:1, preferably between about 1.1:1 and 1.5:1. Excess ethylene oxide is removed after completion of the reaction by blowing the reaction mixture at an elevated temperature, generally with inert gas such as nitrgoen. The foregoing reactions are conducted in the presence of a hydrocarbon lubricating oil described in connection with the sulfurized normal calcium alkylphenolate. The lubricating oil normally constitutes between about 20 and 80 wt. % of the reaction mixture.

The introduction of the hydrocarbon lubricating oil normally takes place subsequent to steam hydrolysis. The ethoxylated derivative on an oil free basis normally has a sulfur content of between about 2 and 5 wt. % and a phosphorus content of between about 4 and 6 wt. %.

Specific examples of the ethoxylated derivative of the inorganic phosphorus acid free, steam hydrolyzed polybutene-$P_2S_5$ reaction product are ethoxylated steam hydrolyzed polyisobutene (1100 m.w.)-$P_2S_5$ reaction product, ethoxylated, steam hydrolyzed polybutene (1500 m.w.)-$P_2S_5$ reaction product, ethoxylated, steam hydrolyzed polybutene (800 m.w.)-$P_2S_5$ reaction product, ethoxylated, steam hydrolyzed polyisobutene (2000 m.w.)-$P_2S_5$ reaction product where the ethylene oxide component and the reaction product component are present in a mole ratio of 1:1.

In regard to the aforementioned alternative supplementary succinimide, this succinimide may be characterized by the formula:

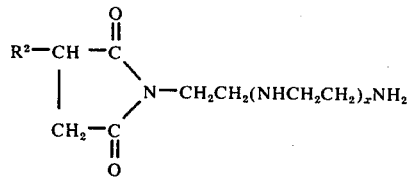

where $R^2$ is alkenyl of from 50 to 200 carbons, $x$ is an integer of from 0 to 10, particularly suitable examples are where $R^2$ is polyisobutylene of a molecular weight of about 1000 to 1500 and $x$ is 4 and where R is polyisobutylene of about 1000 to 1500 m.w. and $x$ is 5 and mixtures thereof.

The following examples further illustrate the invention but are not to be construed as limitations thereof.

EXAMPLE I

This example illustrates the preparation of the product of the invention. It is to be noted throughout the entire following described procedure, that is, following described steps 1, 2 and 3, nitrogen blowing of the reaction mixture was conducted at 500 cc/minute except when $CO_2$ blowing is specified.

Step 1: To a 12 liter flask fitted with a Dean-Stark trap and an inert gas inlet, there was charged 2800 grams of 4-dodecylphenol at ambient temperature and the product was heated for a period of 2.5 hours to 330°F. There was then charged 1263 grams (2.8 mole calcium) of a 42.3 wt. % Ca solution of calcium 2-methoxyethoxide in 2-methoxyethanol over a period of 1 hour and the methoxyethanol together with other volatile by-product materials were stripped off for a period of 4.5 hours during which time the temperature was raised from 330° to 410°F.

Step 2: To the calcium alkylphenolate reaction mixture of step 1, there was changed over an hour period a sulfur slurry (420 grams sulfur + 500 grams naphthenic oil of an SUS viscosity of about 100° at 100°F.) while maintaining the temperature at 410°F. Subsequently, the resultant mixture was heated over an hour period from 410° to 450°F. and maintained at 450°F. for an additional 6 hours, followed by $CO_2$ blowing (500 ccs/minute) for a 1 hour period at 450°F. and then nitrogen blowing was reinstituted for an additional hour at that temperature.

Step 3: The sulfurized reaction mixture of step 2 was cooled to 350°F. over an hour period and an additional 2630 grams of the aforedescribed naphthenic lube oil was added and the resultant diluted mixture was reheated over a ⅔ hour period from 280° to 330°F. At the end of the reheating period, an additional 1263 grams (2.8 mole calcium) of a 42.3 wt. % solution of calcium 2-methoxyethoxide in methoxyethanol were added over an hour period at 330°F. Subsequently, the resultant reaction mixture is nitrogen stripped over a 4 hour period of methoxyethanol solvent and volatile by-products while during that period the temperature being raised from 330° to 410°F. and then filtered utilizing a vacuum filter at 300°F. for a 3 hour period. Analysis of the filtrate determined it to be a lube oil concentrate of sulfurized calcium dodecylphenolate, the concentrate giving the following analysis: wt. % Ca: 3.3; wt. % sulfur: 2.8; TBN (Total Base Number): 92.

EXAMPLE II

The procedure of Example I was repeated except the 450°F. sulfurization time in step 2 was cut down to 3 hours. This consisted of consecutively blowing for 1 hour intervals with $N_2$, $CO_2$ and $N_2$ and the final product is held at 300°F. for 5 hours with $N_2$ blowing at 500 ccs/minute.

The final process product was identified as a lubricating oil concentrate of sulfurized calcium dodecylphenolate, the solution giving the following analysis: wt. % Ca: 3.5; wt. % S: 2.6; TBN: 99.

EXAMPLE III

This example illustrates a comparative prior procedure for the formulation of sulfurized calcium alkylphenolate. The following described method is essentially that of representative procedures in Examples I and II except in the second stage sulfurization the temperature is 410°F. rather than 450°F. and diluent oil is added in an amount so that it would constitute about 50 wt. % of the reaction mixture during sulfurization.

To a 2-liter flask fitted with a Dean-Stark trap and an inert gas inlet there was charged 280 grams (1 mole) of 4-dodecylphenol and 350 grams of a naphthenic lubricating oil of an SUS viscosity of about 100 at 100°F. The resultant mixture was heated with stirring to a temperature of about 350°F. and 140 grams (0.25 mole calcium) of a 34 wt. % solution of calcium 2-methoxyethoxide in 2-methoxyethanol were added and the reaction mixture was stripped over a 20 minute period with nitrogen while heating the mixture to 410°F. Powdered sulfur in an amount of 40 grams (1.25 moles) was added with continued stirring and the mixture was kept at 410°F. for a 3 hour period while sequentially blowing 1 hour with nitrogen, 1 hour with carbon dioxide and then 1 hour with nitrogen at a gas rate of 500 mls./minute/liter. At the end of the 3 hour period an additional portion in an amount of 140 grams of the 2-methoxyethoxide solution was added dropwise and the solvent was removed as overhead while maintaining the reaction mixture at 410°F. The product yield was 658 grams (95 wt. % of theory). Analysis of the product determined it to be a lubricating oil concentrate of sulfurized calcium dodecylphenolate, the solution giving the following analysis: wt. % Ca: 2.62; wt. % S: 2.55; TBN: 81.

EXAMPLE IV

The procedure of Example I was used except 410°F. sulfurization temperature was used and no diluent oil was present during sulfurization step. All the diluent was added in the final step.

The final process product was identified as a lubricating oil concentrate of sulfurized calcium dodecylphenolate the solution giving the following analysis: wt. % Ca: 3.1; wt. % S: 2.6; TBN: 87.

EXAMPLE V

The procedure of Example I was repeated except a 475°F. for 3 hour sulfurization temperature was applied. The final product was identified as lubricating oil concentrate of sulfurized calcium dodecylphenolate, the solution giving the following analysis: wt. % Ca: 3.5; wt. % S: 2.8; TBN: 99.

EXAMPLE VI

The following example illustrates the superiority of the sulfurized calcium alkylphenolate of the invention in respect to resistance oxidation and as a corrolary such a showing illustrates the material difference in the composition of the sulfurized calcium alkylphenolates of the invention in respect to those of the past.

Representative and formulations of the invention and comparative formulations were subjected to the following described tests:

Oil Oxidation Test

The test method involves bubbling 5 liters of oxygen per hour through 300 mls. of test oil composition at 285°F. in which there is immersed a 1×3×0.06 inch steel backed copper-lead test specimen cut from bearing stock. The viscosity of the test oil is measured before and after the 144 hour test period and greater the difference in viscosity the greater the oxidative deterioration of the sulfurized calcium alkylphenolate composition. In addition, the test specimen is weighed before and after the test period and the greater the weight loss of test specimen the greater the oxidative deterioration of the test formulation. Further, the larger the amount of copper, iron and lead moieties found in the oil after test the greater the oxidative deterioration thereof.

The representative Formulations A, B, F, G and comparative Formulations C, D and F and their oxidation test results are reported below in Table I:

TABLE I

| Composition | A | B | C | D | E | F | G |
|---|---|---|---|---|---|---|---|
| Ingredients | | | | | | | |
| Mineral Oil (1000 SUS at 100°F.) | 90.1 | 90.1 | 90.1 | 90.1 | 90.1 | 88 | 87.95 |
| Example I Prod. | 6.7 | — | — | — | — | 10 | — |
| Example II Prod. | — | 6.7 | — | — | — | — | 10 |
| Example III Prod. | — | — | 6.7 | — | — | — | — |
| Example IV Prod. | — | — | — | 6.7 | — | — | — |
| Example V Prod. | — | — | — | — | 6.7 | — | — |
| Ethoxylated Derivative[a] | 3.2 | 3.2 | 3.2 | 3.2 | 3.2 | — | — |
| Succinic Anhydride[b] | — | — | — | — | — | 2 | 2 |
| 2,5-Bis octyl dithiothiadiazole | — | — | — | — | — | — | 0.05 |
| Elemental Analysis Unused Oil | | | | | | | |
| Wt. % Ca | 0.2 | 0.2 | 0.2 | 0.2 | — | 0.3 | 0.3 |
| Wt. % P | 0.03 | 0.03 | 0.03 | 0.03 | — | — | — |
| Wt. % N | — | — | — | — | — | 0.02 | 0.02 |
| Oxidation Test | | | | | | | |
| % Visc. Increase | 15 | 11 | 84 | 51 | >20 | 4.5 | 6.1 |
| Cu in oil, ppm | 0 | 3 | 30 | 18 | — | 0 | 6 |
| Fe in oil, ppm | 0 | — | 3 | <3 | — | 0 | 0 |
| Pb in oil, ppm | 590 | 470 | 600 | >600 | — | 140 | 0 |
| Wt. loss Catalyst, mg. | 249 | 18 | 373 | 312 | >50 | 45 | 0 |

TABLE I-continued

| Composition | A | B | C | D | E | F | G |
|---|---|---|---|---|---|---|---|
| Used Oil Analysis | | | | | | | |
| pH | 5.5 | 5.4 | 2.1 | 2.8 | — | 7.3 | 6.4 |
| Total Acid No. | 2.6 | 2.1 | 10.4 | 4.9 | — | 2.6 | 2.6 |
| Total Base No. | 1.1 | 0.6 | 0 | 0 | — | 3.1 | 2.2 |

[a]Concentrate consisting of 44:66 weight ratio of oil ethoxylated derivative of an inorganic phosphorus acid free, steam hydrolyzed polyisobutene (~1200 m.w.)-$P_2S_5$ reaction product.

[b]Concentrate consisting of a 50:50 weight ratio of oil to polybutene (~1200 m.w.) succinimide of tetraethylene pentamine.

We claim:

1. A lubricating oil composition comprising a hydrocarbon oil of lubricating viscosity containing between about 0.1 and 90 wt. % of a sulfurized calcium alkylphenolate, said alkylphenolate having a calcium metal ratio of about 1 to 1, a calcium content between about 1 and 8 wt. % and a sulfur content between about 0.5 and 12 wt. % wherein said sulfurized calcium alkylphenolate is produced by:

1. first contacting an alkylphenol

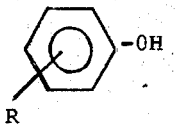

where R is alkyl of from 5 to 50 carbons with a first addition of calcium alkoxyalkoxide of the formula:

$Ca(O\text{-}A\text{-}OR')_2$ where A is alkanediyl of from 1 to 6 carbons and R′ is alkyl of from 1 to 25 carbons at a first temperature between about 200° and 420°F. utilizing a mole ratio of calcium alkoxyalkoxide to said alkylphenol of between about 0.225:1 and 0.45:1, 2. second contacting the resultant mixture with sulfur in the presence of hydrocarbon lubricating oil at a second temperature between about 440° and 460°F. utilizing a mole ratio of sulfur to initial alkylphenol of between about 0.5:1 and 8:1, said hydrocarbon oil in said second contacting constituting between about 13 and 20 wt. % of said reaction mixture and
3. subsequently third contacting the mixture with a second addition of calcium alkoxyalkoxide at said first temperature in a mole ratio of calcium alkoxyalkoxide to initial alkylphenol of between about 0.15:1 and 0.375:1 in sufficient amount so that the total calcium alkoxyalkoxide employed in the first and third contacting will total a mole ratio of calcium alkoxyalkoxide to initial alkylphenol of between about 0.5:1 and 0.6:1.

2. A lubricating oil composition in accordance with claim 1 wherein the reaction mixture during said first and third contacting is blown with inert gas at a gas rate of between about 0.1 and 10 SCFH/gallon and during said second contacting sequentially blown with inert gas, carbon dioxide and inert gas at an inert gas and carbon dioxide rate of between about 0.1 and 10 SCFH/gallon.

3. A lubricating oil composition in accordance with claim 2 wherein said inert gas is nitrogen.

4. A lubricating oil composition in accordance with claim 1 wherein said alkylphenol is 4-dodecylphenol, said calcium alkoxyalkoxide is calcium 2-methoxyethoxide dissolved in methoxyethanol wherein the reaction mixture during said first and third contactings is blown with inert gas at a gas rate between about 0.1 and 10 SCFH/gallon and during said second contacting sequentially with nitrogen, carbon dioxide and nitrogen at a gas rate of between about 0.1 and 10 SCFH/gallon.

5. A lubricating oil composition in accordance with claim 1 containing between about 0.1 and 10 wt. % of sulfurized calcium alkylphenolate.

6. A lubricating oil composition in accordance with claim 1 in concentrate form containing between about 10 and 90 wt. % of said sulfurized calcium alkylphenolate.

7. A lubricating oil composition in accordance with claim 2 containing between about 0.1 and 10 wt. % said sulfurized calcium alkylphenolate, and between about 1 and 10 wt. % of a supplementary dispersant selected from the group consisting of 1). ethoxylated inorganic phosphorus acid free, steam hydrolyzed polybutene (800-2500 mw.)-$P_2S_5$ reaction product, said ethylene oxide moiety being present in respect to said hydrolyzed polybutene-$P_2S_5$ reaction product in a mole ratio of about 1:1 and polybutene-$P_2S_5$ component being present in a mole ratio to one another of between about 1:1, 2). and an alkenyl succinic anhydride derivative of alkylene polyamine characterized by the formula:

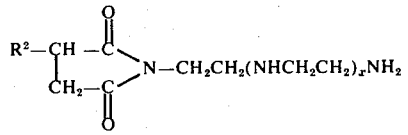

where $R^2$ is alkenyl of from 50 to 200 carbons, $x$ is an integer of from 0 to 10.

8. A composition in accordance with claim 7 wherein said supplementary dispersant is said ethoxylated derivative and said polybutene is of a molecular weight of about 1200.

9. A composition in accordance with claim 7 wherein said supplementary dispersant is the polybutene (~1200 m.w.) succinic anhydride derivative of tetraethylene pentamine.

10. A lubricating oil composition in accordance with claim 7 which also includes between about 0.01 and 1.0 wt. % of a 2,5-bis $C_5$ to $C_{20}$ alkyl dithiothiadiazole.

11. A lubricating oil composition in accordance with claim 10 wherein said alkyl dithiothiadiazole is 2,5 bis octyl dithiothiadiazole.

* * * * *